US007640903B2

(12) United States Patent
Stork et al.

(10) Patent No.: US 7,640,903 B2
(45) Date of Patent: Jan. 5, 2010

(54) DEVICE FOR ADJUSTING THE POSITION OF THE ANGLE OF ROTATION OF THE CAMSHAFT OF A RECIPROCATING PISTON INTERNAL COMBUSTION ENGINE IN RELATION TO THE CRANKSHAFT

(75) Inventors: Holger Stork, Buhl (DE); Heiko Dell, Buhlertal (DE); Minh Nam Nguyen, Buhl (DE)

(73) Assignee: Schaeffler KG, Herzogenaurach (DE)

( * ) Notice: Subject to any disclaimer, the term of this patent is extended or adjusted under 35 U.S.C. 154(b) by 271 days.

(21) Appl. No.: 11/575,904

(22) PCT Filed: Sep. 16, 2005

(86) PCT No.: PCT/DE2005/001625

§ 371 (c)(1),
(2), (4) Date: Apr. 27, 2007

(87) PCT Pub. No.: WO2006/032242

PCT Pub. Date: Mar. 30, 2006

(65) Prior Publication Data

US 2008/0245329 A1 Oct. 9, 2008

(30) Foreign Application Priority Data

Sep. 24, 2004 (DE) ..... 10 2004 046 463

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 5,680,837 | A * | 10/1997 | Pierik | 123/90.17 |
| 2001/0042528 | A1* | 11/2001 | Takahashi | 123/90.15 |
| 2003/0135321 | A1* | 7/2003 | Kumazaki et al. | 701/112 |
| 2004/0020452 | A1* | 2/2004 | Park | 123/90.15 |

(Continued)

FOREIGN PATENT DOCUMENTS

| | | |
|---|---|---|
| DE | 4121520 | 1/1992 |

(Continued)

*Primary Examiner*—Zelalem Eshete
(74) *Attorney, Agent, or Firm*—Volpe and Koenig, P.C.

(57) ABSTRACT

A device for adjusting the position of the angle of rotation of the camshaft of a reciprocating piston internal combustion engine relative to the crankshaft in a motor vehicle is provided, which includes an adjusting gear mechanism in the form of a triple shaft gear mechanism having a drive shaft fixed to the crankshaft, an output shaft fixed to the camshaft and an adjustment shaft which is drivingly connected to an electric motor which can be positioned using an electric control device. The ignition of the internal combustion engine is connected to the motor vehicle battery via an ignition switch. The motor vehicle also includes at least one device which can be adjusted by a user of the vehicle. A monitoring circuit provided with at least one sensor for detecting a change of state of the at least one device. The monitoring circuit is connected to the control device when the latter is switched off, such that the control device is switched on when a change in state is detected.

8 Claims, 1 Drawing Sheet

U.S. PATENT DOCUMENTS

2005/0211207 A1 9/2005 Urushihata et al.

FOREIGN PATENT DOCUMENTS

| | | |
|---|---|---|
| DE | 19906950 | 8/2000 |
| DE | 10317653 | 11/2004 |
| EP | 0643222 | 3/1995 |
| FR | 2724693 | 3/1996 |
| WO | WO 2004038200 | 5/2004 |

* cited by examiner

DEVICE FOR ADJUSTING THE POSITION OF THE ANGLE OF ROTATION OF THE CAMSHAFT OF A RECIPROCATING PISTON INTERNAL COMBUSTION ENGINE IN RELATION TO THE CRANKSHAFT

BACKGROUND

The invention relates to a device for adjusting the rotational angle position of the camshaft of a reciprocating piston internal combustion engine relative to the crankshaft in a motor vehicle, wherein the device has an adjustment gear mechanism, which comprises a triple-shaft gear mechanism with a crankshaft-fixed drive shaft, a camshaft-fixed output shaft, and an adjustment shaft, which is drivingly connected to an electric motor that can be positioned by a control device, wherein the ignition of the internal combustion engine can be connected via an ignition switch to the battery of the motor vehicle, and wherein the motor vehicle also has at least one device that can be adjusted by a user of the motor vehicle.

Such a device is known in practice. It allows an adjustment of the phase position of the camshaft relative to the crankshaft that drives it during the operation of the internal combustion engine. In comparison with an internal combustion engine that is operated at a constant phase position, a better filling of the cylinders of the internal combustion engine can be achieved by this adjustment of the phase position, whereby fuel is saved, pollutant emissions are reduced, and/or the output power of the internal combustion engine can be increased. The control device is turned on together with the ignition of the internal combustion engine via an ignition switch with the help of an ignition key. After turning on the ignition, first a microcontroller integrated into the control device is started, wherein, among other things, various test routines are executed and memory locations in a volatile semiconductor memory of the control device are loaded with start values. In addition, the rotor of the electric motor is positioned in a given position relative to the stator. The period that the control device requires after turning on until it is ready to operate equals approximately 50 to 150 milliseconds. The driver of the motor vehicle senses this period as disruptive, because the internal combustion engine cannot start immediately after turning on the ignition, but instead must first wait until the boot process has completed. Of course, it would be conceivable to start the internal combustion engine before this time period has elapsed, but this has the disadvantage that during the startup phase, an increased pollutant load would be produced in the exhaust stream of the internal combustion engine.

SUMMARY

Therefore, there is the objective of providing a device of the type noted above, which allows quick startup of the internal combustion engine with low pollutant emissions.

This objective is met in that the device has a monitoring circuit with at least one sensor for detecting a state change of the one or more devices and that, when the control device is turned off, the monitoring circuit is connected to the control device, such that the control device is turned on when the state change is detected.

Therefore, advantageously it is possible to turn on the control device before the driver activates the ignition switch of the motor vehicle, so that the camshaft adjustment device is ready to operate at the same time that the ignition switch is activated and the internal combustion engine can start immediately.

In a preferred embodiment of the invention, the monitoring circuit has a timer for measuring the time period that has elapsed since the detection of the last state change of the device that can be adjusted by the user and an input for an operating state signal of the internal combustion engine, wherein the monitoring circuit is constructed so that when the control device is turned on, the power supply to the control device is interrupted when the internal combustion engine is turned off and the time period exceeds a given value. If the user should activate the device without then starting the internal combustion engine within the given time period, the control device is turned off again, in order to conserve the battery of the motor vehicle.

In one advantageous construction of the invention, the sensor is constructed for monitoring the position of an activation element of the motor vehicle. Here, the activation element is selected so that it is normally activated only by the driver of the motor vehicle, e.g., a brake, gas, and/or clutch pedal, a hand-brake handle, a transmission gear stick, a steering wheel, and/or a driver seat adjustment device.

In another advantageous embodiment of the invention, the sensor is constructed for detecting a change in position of the body of the motor vehicle. Here, the sensor can be, for example, a wheel rotational speed sensor, which can also be used optionally for an anti-lock system, an anti-skid controller, and/or electronic stabilization of the driving state (ESP, DSC) of the motor vehicle. The sensor can also be a motion sensor for detecting the position of the vehicle body or a part connected to the body relative to a driving gear (driving gear connecting rod, plunger rod, steering tie rod, etc.). The motion sensor can optionally also be used for a theft-warning device and/or a device for reducing vehicle rollover movements.

The sensor can also be constructed for monitoring the seat occupancy of the driver seat of the motor vehicle. Such a sensor can be, for example, a pressure-sensitive sensor mat, which is built into or onto the seat support of the driver seat and which is activated by the weight of the driver. The sensor, however, can also be an optical sensor, e.g., a camera, which is connected to an image-processing device for identifying the driver. Such seat-occupancy sensors are already known in vehicles equipped with a passenger-side airbag, but are usually installed only on the passenger seat, so that in the case of an accident, the passenger-side airbag can be triggered only if a passenger is detected.

In another advantageous embodiment of the invention, the sensor is constructed for monitoring the operating state of a communications device of the motor vehicle. Here, the sensor can be embodied, for example, for detecting a telephone card in an internal telephone in the vehicle. It is also possible, however, that the sensor recognizes the connection of a cellular telephone with an internal hands-free kit within the vehicle, wherein the connection can also optionally be realized via radio, for example, via a Bluetooth interface.

In a preferred construction of the invention, the sensor is constructed for monitoring the operating state and/or an operating state change of a locking device and/or a theft-monitoring device of the vehicle. Here, the sensor can be, for example, a part of a central locking system, preferably a radio receiver for detecting an electronic key (radio remote control, keyless go, etc.) carried by the driver. The sensor, however, can also be a key contact in the steering-wheel lock of the vehicle, which identifies an ignition key before the driver turns on the ignition with the ignition key or starts the internal combustion engine. The operating state change detected by the sensor can also include turning off an internal theft-warning system within the vehicle.

BRIEF DESCRIPTION OF THE DRAWING

Below, the invention is explained in more detail with reference to the drawing. The sole FIGURE shows:

A schematic representation of a camshaft adjustment device installed in a reciprocating piston internal combustion engine.

DETAILED DESCRIPTION OF THE PREFERRED EMBODIMENT

Figure 1:
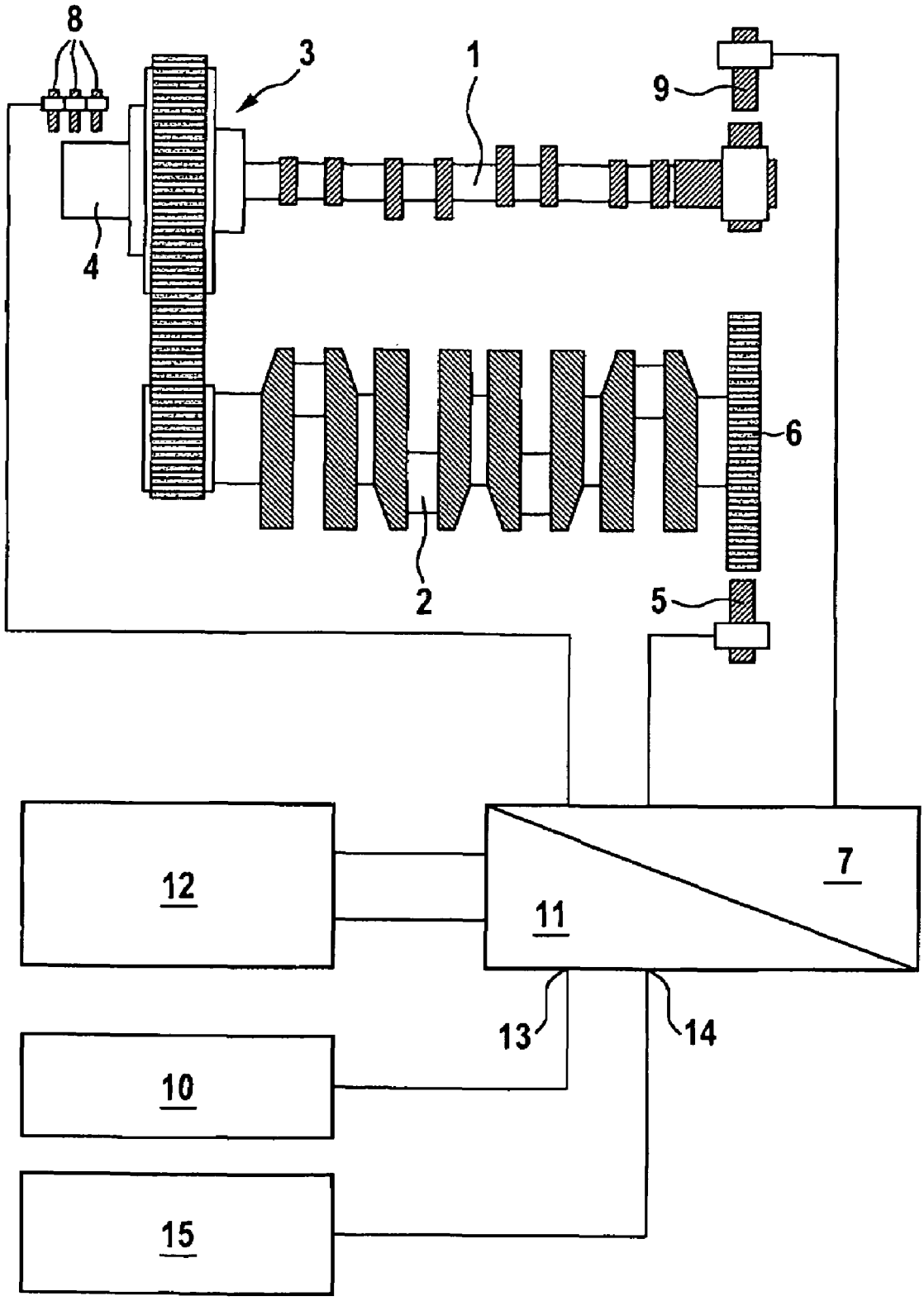

An adjustment device arranged in a motor vehicle for adjusting the rotational angle or phase position of the camshaft 1 of a reciprocating piston internal combustion engine relative to the crankshaft 2 includes an adjustment gear mechanism 3, which is constructed as a triple-shaft gear mechanism with a crankshaft-fixed drive shaft, a camshaft-fixed output shaft, and an adjustment shaft drivingly connected to the rotor of an electric motor 4.

For determining the rotational angle position of a crankshaft 2, the device has an inductive detector 5, which registers the tooth flanks of a toothed ring 6 composed of a magnetically conductive material and arranged on the crankshaft 2. One of the tooth gaps or teeth of the toothed ring 6 has a larger width than the other tooth gaps or teeth and is used as a reference mark. When the reference mark passes the sensor 5, the measurement value for the crankshaft rotational angle is set to a start value. Then the measurement value is advanced for each detection of a tooth flank when the reference mark passes the sensor 5 again. The measurement value for the crankshaft angle is advanced with the help of a control device 7, in whose operating program an interrupt is triggered for each detection of a tooth flank.

An EC motor is provided as the electric motor 4, which has a rotor, on whose periphery is arranged a series of magnetic segments, which are magnetized alternately relative to each other in opposite direction and which interact magnetically in a known way via an air gap with teeth of a stator. The teeth are wrapped with a winding that is energized by the control device 7.

The position of the magnetic segments relative to the stator and thus to the adjustment shaft rotational angle is detected with the help of a measurement device, which has, on the stator, several magnetic field sensors 8 that are offset relative to each other in the circumferential direction of the stator, such that a digital sensor signal, which cycles through a sequence of sensor signal states, is generated when the rotor rotates. For each occurrence of a change in the sensor signal state, an interrupt is triggered in the control device 7, in which a position measurement value is advanced.

A value for the phase position is determined from the measurement value for the position of the rotor and the crankshaft rotational angle with the help of a known stationary transmission gear ratio of the triple-shaft gear mechanism. With the help of a trigger device 9, a camshaft-synchronous trigger signal is generated, that sets the time points, at which a cyclical interrupt is triggered in the control device 7, in which the phase position is determined from the measurement values for the rotor position and the crankshaft rotational angle. The phase position is compared with a desired value in the control device 7 and if there is a deviation, the position of the rotor is changed by the control device 7, such that the deviation is reduced.

The ignition of the internal combustion engine is turned on by a driver by means of an ignition switch 10, which is arranged on the dashboard and which can be actuated, for example, with the help of an ignition key. In the drawing it can be seen that the control device 7 is connected to the battery 12 of the motor vehicle via a monitoring circuit 11. The monitoring circuit 11 has a first input 14, which is connected to a sensor 15 for detecting a state change of a brake pedal. A second input 13 of the monitoring circuit 11 is connected to the ignition switch 10. The sensor 15 can be, for example, an electric switch, which is connected in terms of actuation to the brake pedal directly or via an intermediate hydraulic line.

The motor vehicle also has a startup switch not shown in more detail in the drawing for electrical actuation of a starter motor of the internal combustion engine. For the startup switch, a locking device is provided, which blocks the actuation of the starter if the brake pedal is not depressed. Thus, to start the internal combustion engine, the driver must first press down on the brake pedal and then actuate the startup switch with the brake pedal depressed.

The monitoring circuit 11 is constructed as a wake-up circuit, which monitors the state of the brake pedal when the control device 7 is turned off and which turns on the control device 7 when a state change is identified. The monitoring circuit 11 applies a corresponding wake-up signal to the first input 14. A semiconductor switch or a relay, which is arranged in a power-supply line connecting the control device 7 to the battery 12, is closed as a function of the wake-up signal. The control device 7 is thus already turned on when the brake pedal is actuated. Then the control device 7 is started immediately, wherein a system check is performed, in which various test routines are executed for testing functions of the control device and startup values for recording the actual operation of the device are stored in a semiconductor memory. If no errors appear in the system check, the rotor of the electric motor is positioned in a given starting position and then the startup of the internal combustion engine is released. The time period, which the control device requires for startup, is dimensioned so that it is smaller than the time period that normally elapses for an average driver between the actuation of the brake pedal and the actuation of the start switch for the starter motor. The control device is thus started before the driver actuates the starter motor, so that the driver does not notice the startup. The time for startup can optionally be reduced, such that the number and expense for the internal system check and also the number of variables to be initialized is kept as small as possible. After the control device 7 is turned on, initially the start values have not yet been read from the EEprom, but instead given standard values are used as the start values. The EEprom is first read during the first seconds of operation.

The monitoring circuit 11 has a timer not shown in more detail in the drawing for measuring the time period elapsed since the detection of the last state change of the brake pedal. If the driver does not turn on the ignition within this time period, the power supply to the control device 7 is disconnected again. While the ignition is turned on, the control device is always turned on.

LIST OF REFERENCE SYMBOLS

1 Camshaft
2 Crankshaft
3 Adjustment gear mechanism
4 Electric motor
5 Detector
6 Toothed ring
7 Control device
8 Magnetic field sensor
9 Trigger device
10 Ignition switch

11 Monitoring circuit
12 Battery
13 Second input
14 First input
15 Sensor

The invention claimed is:

1. Device for adjusting a rotational angle position of a camshaft of a reciprocating piston internal combustion engine relative to a crankshaft in a motor vehicle, comprising an adjustment gear mechanism, which is constructed as a triple-shaft gear mechanism with a crankshaft-fixed drive shaft, a camshaft-fixed output shaft, and an adjustment shaft drivingly connected to an electric motor that can be positioned by an electric control device, wherein an ignition of the internal combustion engine can be connected via an ignition switch to a battery of the motor vehicle, and the motor vehicle also has at least one device that can be adjusted by a user of the motor vehicle, the at least one device has a monitoring circuit with at least one sensor for detecting a state change of the at least one device, and when the control device is turned off, the monitoring circuit is connected to the control device, such that the control device is turned on when a state change is detected to initiate a system check and to initialize a starting position of the adjustment gear mechanism.

2. Device according to claim 1, wherein the monitoring circuit has a timer for measuring a time period that has elapsed after a detection of a last state change of the device that can be adjusted by the user and an input for an operating state signal of the internal combustion engine, and the monitoring circuit is constructed such that when the control device is turned on, a power supply to the control device is disconnected if the internal combustion engine is turned off and the timer measured period exceeds a given value.

3. Device according to claim 1, wherein the sensor is constructed for monitoring a position of an actuation element of the motor vehicle.

4. Device according to claim 1, wherein the sensor is constructed for detecting a change in position of a body of the motor vehicle.

5. Device according to claim 1, wherein the sensor is constructed for monitoring seat occupancy of a driver seat of the motor vehicle.

6. Device according to claim 1, wherein the sensor is constructed for monitoring an operating state of a communications device of the motor vehicle.

7. Device according to claim 1, wherein the sensor is constructed for monitoring at least one of an operating state or an operating state change of a locking device of the vehicle.

8. Device according to claim 1, wherein the sensor is constructed for monitoring at least one of an operating state or an operating state change of a theft-monitoring device of the vehicle.

* * * * *